US011148860B2

(12) United States Patent
Aranda Campin et al.

(10) Patent No.: US 11,148,860 B2
(45) Date of Patent: Oct. 19, 2021

(54) PROTECTIVE SLEEVE FOR BEVERAGE CANS

(75) Inventors: David Aranda Campin, Saragossa (ES); Sergio Rottier Tuneu, Saragossa (ES); Angel Canals Sin, Saragossa (ES); Alejo Soler-Roig Dualde, Saragossa (ES)

(73) Assignee: ARAGONESA DE DESARROLLOS E INNOVACIONES, S.L., Saragossa (ES)

( * ) Notice: Subject to any disclaimer, the term of this patent is extended or adjusted under 35 U.S.C. 154(b) by 613 days.

(21) Appl. No.: 14/358,829

(22) PCT Filed: Apr. 25, 2012

(86) PCT No.: PCT/ES2012/070282
§ 371 (c)(1),
(2), (4) Date: Aug. 8, 2014

(87) PCT Pub. No.: WO2013/072535
PCT Pub. Date: May 23, 2013

(65) Prior Publication Data

US 2014/0348976 A1 Nov. 27, 2014

(30) Foreign Application Priority Data

Nov. 17, 2011 (ES) ..... ES201131191U

(51) Int. Cl.
*B65D 51/20* (2006.01)
*B65D 17/28* (2006.01)
(Continued)

(52) U.S. Cl.
CPC ..... *B65D 51/20* (2013.01); *B65B 5/04* (2013.01); *B65D 17/28* (2018.01); *B65D 17/32* (2018.01);
(Continued)

(58) Field of Classification Search
CPC ..... B65D 51/20; B65D 17/00; B65D 17/28; B65D 17/32; B65D 17/4012; B65B 5/04
See application file for complete search history.

(56) References Cited

U.S. PATENT DOCUMENTS 3,419,181 A 12/1968 Stec
D309,564 S 7/1990 Rayner
(Continued)

FOREIGN PATENT DOCUMENTS

EP 1728728 12/2006
ES 1063828 12/2006
(Continued)

OTHER PUBLICATIONS

EP1728728translation.*
International Search Report for International Application No. PCT/ES2012/070282, dated Jun. 8, 2012, in 4 pages.

*Primary Examiner* — Erik Kashnikow
*Assistant Examiner* — Chaim A Smith
(74) *Attorney, Agent, or Firm* — Knobbe, Martens, Olson & Bear, LLP

(57) ABSTRACT

The invention relates to a protective sleeve for beverage cans, of the type used as a hygienic protector that can be applied individually to each container, said sleeve including horizontal tearing means for accessing the pull ring of the can and vertical tearing means in the form of a pre-punched longitudinal strip. The sleeve is characterized in that it comprises a tubular body provided with a shaped base and, at the opposite end, an upper body, said sleeve being made from a strong, waterproof, printed material, having a similar configuration to the can and, optionally, including information in braille.

14 Claims, 1 Drawing Sheet

(51) Int. Cl.
*B65B 5/04* (2006.01)
*B65D 17/32* (2006.01)

(52) U.S. Cl.
CPC .. *B65D 17/4012* (2018.01); *B65D 2517/0098* (2013.01)

(56) References Cited

U.S. PATENT DOCUMENTS

| | | | | |
|---|---|---|---|---|
| 5,139,163 | A * | 8/1992 | Diaz | B65D 21/0219 206/509 |
| 5,251,758 | A * | 10/1993 | Kolacek | A47G 21/00 206/459.5 |
| D365,988 | S | 1/1996 | Clarke, III | |
| D371,075 | S | 6/1996 | Stonehouse | |
| 5,979,748 | A * | 11/1999 | Drummond | B29C 53/78 156/69 |
| 5,983,607 | A * | 11/1999 | Mihalov | B29C 65/18 53/478 |
| 6,073,797 | A | 6/2000 | Barous | |
| 7,017,769 | B1 | 3/2006 | Talmon | |
| D623,963 | S | 9/2010 | Fairchild et al. | |
| D632,588 | S | 2/2011 | George | |
| D632,589 | S | 2/2011 | George | |
| D641,644 | S | 7/2011 | George | |
| D671,843 | S | 12/2012 | Plosky et al. | |
| D693,698 | S | 11/2013 | Miller, Jr. | |
| D695,138 | S | 12/2013 | Ball | |
| 8,985,371 | B2 | 3/2015 | Zabaleta et al. | |
| D732,402 | S | 6/2015 | Jones et al. | |
| 2007/0163896 | A1 * | 7/2007 | Mazurek | B65D 15/08 206/1.5 |
| 2012/0187126 | A1 | 7/2012 | Shemesh | |
| 2012/0205378 | A1 | 8/2012 | Forrest | |
| 2013/0200034 | A1 | 8/2013 | Kaanta et al. | |

FOREIGN PATENT DOCUMENTS

| | | |
|---|---|---|
| ES | 1067176 | 4/2008 |
| ES | 1068797 | 12/2008 |
| JP | 7315379 | 12/1995 |

* cited by examiner

PROTECTIVE SLEEVE FOR BEVERAGE CANS

As its title indicates, the present description refers to a protective sleeve for beverage cans of the type of those used as hygienic protection which can be applied individually to individual containers, including horizontal tearing means for accessing the pull ring of the can and vertical tearing means in the form of a pre-punched longitudinal strip, characterised in that it comprises a tubular body provided with a shaped base and at the opposite end an upper body, made of a strong waterproof printed material having a similar configuration to the can and optionally including information in braille.

As is known, beverage cans are a widely used type of container whose main advantage lies in the ease with which they can be used, without the need to resort to glasses or other containers for appropriate and convenient consumption of their contents. However containers of this type have a major disadvantage in that in the course of their transport, handling and/or storage, which may be quite prolonged, the cans can easily collect dirt of all kinds from mere dust to any type of substance which may spill or accumulate on them, to excrement or urine from different animals (rats, cockroaches, ants, flies) which commonly swarm uncontrollably in the distribution chain.

In some cases this problem is partly solved by wrapping the "packs" or groups of cans as used by some companies. However because these wraps do not cover the cans entirely, given that they are partly open, they do not include any type of warranty seal, and also when the said packs are subdivided into loose cans or smaller numbers of cans, the wrapping is broken or even removed, leaving the cans again at the mercy of possible non-hygienic elements, including pathogens, which may reach our mouths if we drink directly from the can.

In addition to this there is an additional disadvantage that applying printing of an informative and/or advertising nature on the metal surface represents a high cost to the manufacturer.

Finally another disadvantage is the additional cost which may be incurred when messages and/or information in braille, which can be read by visually handicapped persons, are included directly on the cans.

It would therefore be desirable to provide another type of protective element which guarantees hygienic conditions on the top surface of each can until the time when it is consumed by the user, and with a view to finding other solutions, patent WO2009/101220 provides a "Protective cover for beverage cans" which comprises a cover providing protection as far as the middle of the container or can, also protecting the top part where the pull ring is located, with the disadvantage that the area for printing is very restricted, as it only covers half the container.

Another solution is that found in patent WO2010/034865, "Protective sleeve and advertising medium for cans of drink" which comprises a sleeve covering the entire can, closed off at the top with a lid, also adding a known tearing means to provide access to the region where the pull ring of the can is located, with the disadvantage that no provision has been made for a tearing system at the top of the sleeve.

In order to solve the problems existing at the present time and in order to improve this type of application as far as possible, a protective sleeve for beverage cans has been envisaged which is characterised in that it comprises a tubular body having a shaped base and, at the opposite end, an upper body.

The tubular body essentially comprises a body made of a suitably waterproof and sufficiently strong material, suitable to be printed, having a tubular configuration similar to that of the can, and firmly fitted thereto.

Another characteristic of the invention is that the tubular body optionally incorporates a longitudinal perforation, made by means of a laser or microperforation, which makes it possible to tear off the protective sleeve.

Printing of the protective sleeve is very much more economical than direct printing on the metal can, also providing the advantage that information content for the visually impaired can be provided in braille, something which is very expensive to carry out directly on the metal container.

The protective sleeve is fitted on the can by means of the thermoforming technique, the cylindrical portion of the can being covered, matching the seating projection of the can at the bottom, creating a shaped base, leaving the top partly covered by the excess material of the tubular body deformed as a result of the heat produced by the thermoforming, leaving the top where the pull ring for the can is located completely uncovered.

To finish off the top, providing the container with a seal providing a complete guarantee of protection and being tamper-proof, a lid is incorporated by means of an automatic bonding process which keeps the container completely closed. The corporate logo of the trade mark or any other type of printing which the manufacturer desires can be printed on this lid.

Another characteristic of the invention is that the lid can be printed on both sides, with the corporate logo of the trade mark or with any other type of printing such as promotions, events, prizes, advertising, etc.

The top tubular body is closed off by means of a lid, being bounded and separated from the cylindrical portion of the tubular body by a horizontal perforation produced by a laser or microperforation in the vicinity of the upper portion around the entire perimeter, which makes it possible to tear off the protective sleeve by mere rotation of the top body to the right or left, providing access to the region where the pull ring of the can is located.

The tearing elements incorporated in the protective sleeve for beverage cans ensure that the product is wholly recyclable, given that once the can has been consumed the entire sleeve can easily be removed from the container by means of the tearing elements which it includes, so that the metal container and the plastics material of the sleeve can be disposed of separately.

The protective sleeve for beverage cans described herein provides the main advantage that it hygienically protects the entire surface of a beverage can with a strong waterproof printed material, which is optionally printed in braille, having a configuration similar to the can, provided with a shaped base and with an upper body at the opposite end.

Another advantage is that the sleeve can optionally incorporate a perforation produced by laser or microperforation in the tubular body, a perforation provided longitudinally which makes it easy to tear off the protective sleeve.

An additional important advantage is that the top body of the sleeve is bounded and separated from the cylindrical part of the tubular body by means of a perforation made by laser or microperforation over its entire perimeter which makes it possible to tear off the protective sleeve through mere rotation of the top body to the right or left, providing direct access to the pull ring of the container.

Another important advantage is that the top body is closed off by means of a lid which is printed in the specific colours of the corresponding logo and optionally also on both sides to make maximum use of the useful space provided for promotions, prizes, etc.

An important advantage is that printing of the protective sleeve is very much more economical than direct printing onto the metal container, that a larger number of colours can be used, and that greater use may be made of the communication surface providing more opportunity for possible changes in design.

An additional advantage is that information content for visually handicapped persons may optionally be printed in braille on the sleeve.

Another important advantage is that the bottom part is fitted into a projection in the can creating a shaped base.

A preferred practical embodiment of this invention is illustrated in the appended drawings to provide a better understanding of its subject matter.

Figure 1:
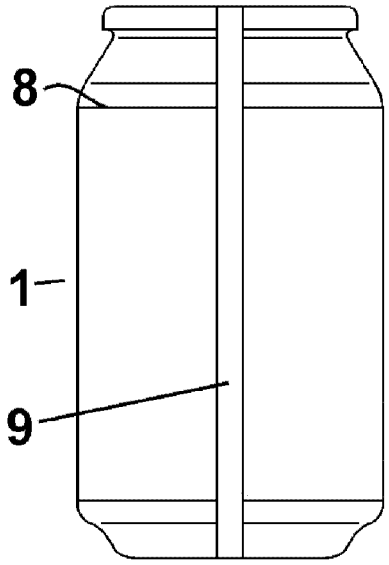
FIG. 1 shows a view in elevation of the protective sleeve covering the entire beverage can, including horizontal tearing means for access to the pull ring of the can and vertical tearing means in the form of a pre-punched longitudinal strip.
Figure 2:
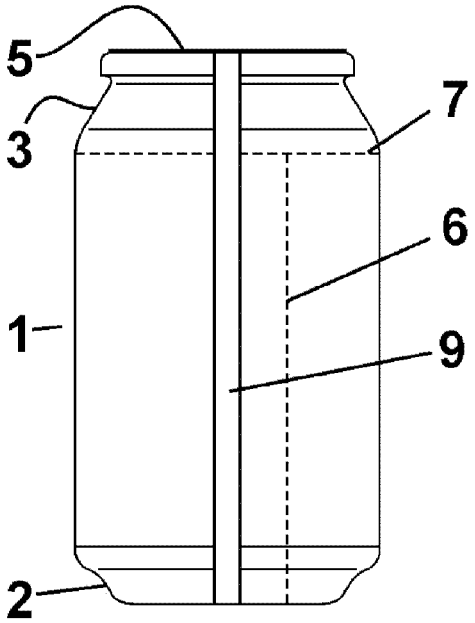
FIG. 2 shows a view in elevation of the protective sleeve object of the invention covering the entire beverage can, including perforations made by laser or microperforating, one in the horizontal direction and one in the vertical direction.
Figure 3:
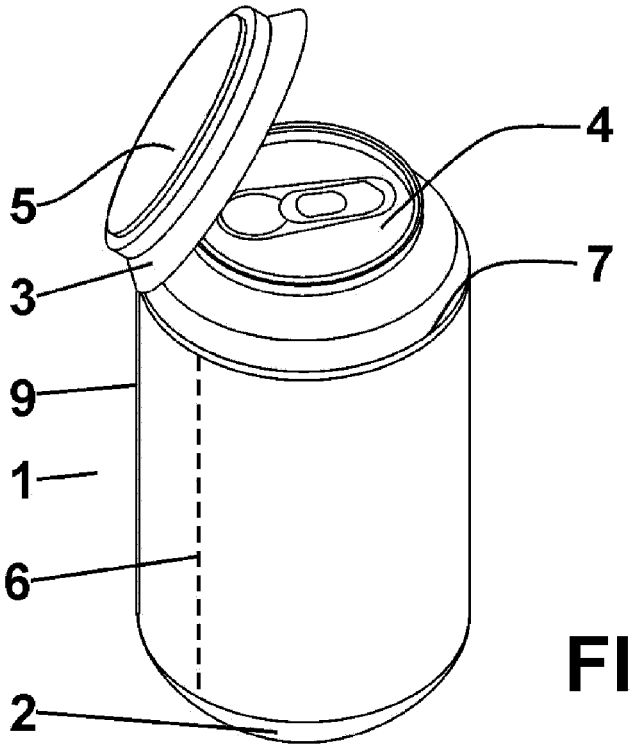
FIG. 3 shows a perspective view of the protective sleeve object of the invention ready for consumption by the user in a completely hygienically safe way.

The protective sleeve for beverage cans herein described is characterised in that it comprises a tubular body (1) provided with a shaped base (2) and at the opposite end an upper body (3), being said sleeve waterproof, strong and printed and has a configuration similar to that of the can (4).

Another characteristic of the invention is that the protective sleeve for beverage cans can incorporate information in braille.

Another characteristic of the invention is that the tubular body (1) optionally incorporates a longitudinal perforation (6) made by means of a laser or microperforation which makes it easier to tear by rotation.

The upper body (3) is closed off by means of a lid (5) which is bounded and separated from the cylindrical portion of the tubular body (1) by means of a horizontal perforation (7) provided around its perimeter, by means of a laser or microperforation, which makes it easier to tear through rotation.

The lid (5) is printed on one side and optionally on both.

The invention claimed is:

1. A protected beverage can, comprising:

a beverage can comprising a bottom, a generally vertical tubular wall, and a top surface having a circumference and fitted with a pull ring for opening the beverage can and accessing contents of the beverage can;

a protective sleeve made of a strong waterproof material wholly fitted to the bottom and tubular wall of the beverage can by thermoforming, the protective sleeve further thermoformed to fold inward over the top surface of the beverage can, forming a flange of the protective sleeve around the circumference of the top surface of the beverage can, the flange covering a portion of the top surface of the beverage can, and leaving a portion of the top surface of the beverage can uncovered by the protective sleeve, the protective sleeve further comprising a line of perforations that circumnavigate an entire perimeter of the tubular wall near the top of the tubular wall; and a lid bonded on top of the flange of the protective sleeve, the lid sized to fully cover the portion of the top surface of the beverage can not covered by the protective sleeve, the lid further sized not to extend beyond the circumference of the top surface of the beverage can, the bond of the lid to the top of the flange of the protective sleeve being sufficiently strong that when the protective sleeve is twisted with force to break the line of perforations, allowing an entire portion of the protective sleeve above the line of perforations to be separated from a portion of the protective sleeve below the line of perforations, the lid remains bonded to the flange of the protective sleeve, so as to provide direct access to the pull ring on the top surface of the beverage can.

2. The protected beverage can of claim 1, wherein the line of perforations is produced by a laser.

3. The protected beverage can of claim 1, wherein the line of perforations is produced by microperforation.

4. The protected beverage can of claim 1, wherein the protective sleeve is further made of a printable material.

5. The protected beverage can of claim 1, wherein the protective sleeve includes information in Braille.

6. The protected beverage can of claim 1, wherein the lid is printed on one or both sides.

7. A method of protecting a can having an uneven top with a pull ring, the method comprising:

using a thermoforming technique to wholly fit a tubular body, made of strong waterproof material, suitable to be printed, to an outer cylindrical portion of the can, matching a seating projection at a bottom of the can, and forming a flange around a portion of the top of the can with a top of the tubular body, leaving the pull ring of the can uncovered;

bonding a lid over the flange on the portion of the top of the can and the tubular body so as to close off and finish off the top of the tubular body; and adding horizontal perforations around an entire perimeter of the tubular body, which permit the entire lid to be removed along with an entire portion of the tubular body above the perforations.

8. The method of claim 7, wherein the protective sleeve is made of a thermoformable material.

9. The method of claim 7, wherein the lid is printed on both sides.

10. The method of claim 7, further comprising forming longitudinal perforations.

11. The method of claim 7, wherein the perforations are made by means of a laser.

12. The method of claim 7, wherein the perforations are provided by microperforation.

13. The method of claim 7, wherein the horizontal perforations are microperforations around an entire perimeter of said sleeve, such that the lid can be removed by rotation of a portion of the sleeve above said microperforations.

14. A method of drinking a beverage from a beverage can having a bottom, a tubular body, and a top with a circumference and a pull ring, the beverage can protected with a protective sleeve made of a strong waterproof material thermoformed to wholly cover and fit outside the bottom and the tubular body of the beverage can, the protective sleeve further thermoformed over top of a circumferential portion of the top of the beverage can, forming a flange of the protective sleeve around the circumferential portion of the top of the beverage can and leaving the pull ring of the beverage can uncovered, the beverage can completely closed off with a lid that is sized to fully cover any portion of the top of the beverage can not covered by the flange and to fit wholly within the circumference of the top of the beverage can, the lid fully and hermetically bonded to the top of the flange of the protective sleeve, the protective sleeve further including a row of horizontal perforations that encircle the beverage can near the top of the tubular body, the method comprising:

rotating the lid left or right relative to the tubular body, thereby tearing the horizontal perforations;

removing the lid along with an entire attached portion of the protective sleeve above the horizontal perforations, thereby providing access to the pull ring of the beverage can;

pulling the pull ring to open the beverage can; and drinking contents of the beverage can.

* * * * *